US009764360B2

(12) United States Patent
Guptail et al.

(10) Patent No.: US 9,764,360 B2
(45) Date of Patent: Sep. 19, 2017

(54) SEPARATOR ATTACHMENT FOR A VIBRATORY APPARATUS

(75) Inventors: William G. Guptail, Huntley, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 700 days.

(21) Appl. No.: 12/353,603

(22) Filed: Jan. 14, 2009

(65) Prior Publication Data

US 2009/0178958 A1 Jul. 16, 2009

Related U.S. Application Data

(60) Provisional application No. 61/021,226, filed on Jan. 15, 2008.

(51) Int. Cl.

| | |
|---|---|
| ***B07B 4/00*** | (2006.01) |
| ***B07B 9/00*** | (2006.01) |
| ***B07B 1/42*** | (2006.01) |
| ***B07B 4/08*** | (2006.01) |
| ***B07B 9/02*** | (2006.01) |
| ***B07B 11/02*** | (2006.01) |

(52) U.S. Cl.

CPC ..... *B07B 9/00* (2013.01); *B07B 1/42* (2013.01); *B07B 4/08* (2013.01); *B07B 9/02* (2013.01); *B07B 11/02* (2013.01)

(58) Field of Classification Search

CPC ..... B07B 4/00; B07B 4/02; B07B 11/028
USPC ..... 209/20, 44.2, 143, 295, 466–469, 644, 209/920, 925

See application file for complete search history.

(56) References Cited

U.S. PATENT DOCUMENTS

| | | | | |
|---|---|---|---|---|
| 2,026,910 | A | 1/1936 | Olsen | |
| 2,147,822 | A | 2/1939 | Peale, Jr. | |
| 2,217,710 | A * | 10/1940 | Shaler | 209/28 |
| 2,667,969 | A * | 2/1954 | Bishop et al. | 209/34 |

(Continued)

FOREIGN PATENT DOCUMENTS

| | | |
|---|---|---|
| DE | 7715662 | 10/1977 |
| DE | 4009554 | 9/1991 |

(Continued)

OTHER PUBLICATIONS

Extended European Search Report from corresponding European application No. EP 09000509, dated May 27, 2011.

*Primary Examiner* — Joseph C Rodriguez
(74) *Attorney, Agent, or Firm* — Cook Alex Ltd.

(57) ABSTRACT

A separator attachment for use with a vibratory apparatus, the attachment including a housing mountable to a vibratory apparatus below a material-conveying surface of the vibratory apparatus, the housing defining a pressure chamber with an inlet and an outlet. The housing has at least one wall with a wall surface having a first end disposed proximate to the outlet of the pressure chamber and a second end. The attachment also includes a deflector plate with a deflector plate surface having a first end disposed proximate to the outlet of the pressure chamber and a second end, the deflector plate surface facing the wall surface. The deflector plate is translatable relative to the at least one wall to vary the spacing between the deflector plate surface and the wall surface. A system including a vibratory apparatus and the attachment may also be defined.

16 Claims, 2 Drawing Sheets

(56) References Cited

U.S. PATENT DOCUMENTS

| | | | | | |
|---|---|---|---|---|---|
| 3,065,853 | A | * | 11/1962 | Binnix | 209/468 |
| 3,232,431 | A | | 2/1966 | Musschoot et al. | |
| 3,464,553 | A | * | 9/1969 | Hancock | 209/467 |
| 3,467,594 | A | | 9/1969 | Musschoot et al. | |
| 3,799,336 | A | * | 3/1974 | Holman | 209/543 |
| 3,865,241 | A | | 2/1975 | Crow | |
| 4,152,255 | A | | 5/1979 | Musschoot | |
| 4,279,740 | A | * | 7/1981 | Isogaya | 209/12.2 |
| 4,466,542 | A | * | 8/1984 | Oetiker et al. | 209/44.2 |
| 4,624,370 | A | | 11/1986 | Danner et al. | |
| 4,715,950 | A | | 12/1987 | Danner et al. | |
| 4,806,235 | A | * | 2/1989 | Mueller | 209/321 |
| 4,844,235 | A | | 7/1989 | Sherman | |
| 4,906,356 | A | | 3/1990 | Musschoot | |
| 4,915,824 | A | | 4/1990 | Surtees | |
| 5,087,351 | A | * | 2/1992 | Valentine, Sr. | 209/20 |
| 5,108,589 | A | | 4/1992 | Sherman | |
| 5,358,121 | A | | 10/1994 | Robak | |
| 5,462,172 | A | | 10/1995 | Kumagai et al. | |
| RE35,331 | E | | 9/1996 | Sherman | |
| 5,904,254 | A | | 5/1999 | Tinsley et al. | |
| 5,964,355 | A | * | 10/1999 | Raura | 209/20 |
| 5,984,105 | A | | 11/1999 | Lease et al. | |
| 6,250,472 | B1 | | 6/2001 | Grubbs et al. | |
| 6,662,953 | B1 | | 12/2003 | Rouse | |
| 7,422,114 | B2 | | 9/2008 | Guptail | |
| 2006/0076279 | A1 | * | 4/2006 | Guptail | 209/321 |

FOREIGN PATENT DOCUMENTS

| | | |
|---|---|---|
| DE | 29508260 | 10/1995 |
| DE | 102005061746 | 7/2007 |
| EP | 1640075 | 3/2006 |
| GB | 1374204 | 11/1974 |
| JP | 04-033327 | 3/1992 |
| JP | 09-192605 | 7/1997 |
| JP | 2001-079493 | 3/2001 |
| JP | 2002-177890 | 6/2002 |
| WO | WO 87/06506 | 11/1987 |

* cited by examiner

SEPARATOR ATTACHMENT FOR A VIBRATORY APPARATUS

This application claims the benefit of U.S. Application No. 61/021,226, filed Jan. 15, 2008, which is hereby incorporated by reference in its entirety in the present application.

BACKGROUND

This patent is directed to a separator attachment for a vibratory apparatus, and, in particular, to a separator attachment for a vibratory apparatus wherein air is used as the working fluid in the separator attachment.

It is known to provide a vibratory apparatus in the form of a so-called separator or classifier.

For example, U.S. Pat. No. 5,984,105 illustrates a classifier using air as the working fluid. In particular, air is directed at right angles to a material stream (shot and fines) passing through the classifier. The air causes the lighter material fraction (fines) to be directed upwards for disposal, while permitting the heavier material fraction (shot) to pass through to an outlet end.

U.S. Pat. No. 4,624,370 illustrates a different type of classifier that also uses air as the working fluid. According to this type of classifier, the air is directed an angle to a material stream passing through the classifier. The air causes the lighter material fraction to pass over a drop-out opening, while the heavier material fraction falls through the drop-out opening. The lighter material fraction subsequently passes through the classifier to an outlet end.

U.S. patent application Ser. No. 11/054,574 illustrates a classifier similar to that disclosed in U.S. Pat. No. 4,624,370. Air is directed at an angle to a material stream passing through the classifier, and the lighter material fraction passes over a drop-out opening, while the heavier material fraction falls through the drop-out opening. According to this application, an adjustable deflector plate is provided to vary the air flow directed at the material stream.

It will be recognized that all of these classifiers are particularly designed to perform separation of the materials passing through the apparatus. That is, the structures used for classification are integrally assembled with the remainder of the apparatus. The portion of the apparatus responsible for classification cannot be removed from the apparatus without destroying the apparatus. Furthermore, in the case of the second and third classifiers mentioned above, the apparatus is not useful for conveying materials without use of the classifier features of the apparatus, because failure to activate the classifier features would cause all of the material passing through the apparatus to exit through the drop-out opening.

SUMMARY

According to an aspect of the present disclosure, a separator attachment for use with a vibratory apparatus is provided. The attachment includes a housing mountable to a vibratory apparatus below a material-conveying surface of the vibratory apparatus, the housing defining a pressure chamber with an inlet and an outlet. The housing has at least one wall with a wall surface having a first end disposed proximate to the outlet of the pressure chamber and a second end. The attachment also includes a deflector plate with a deflector plate surface having a first end disposed proximate to the outlet of the pressure chamber and a second end, the deflector plate surface facing the wall surface. The deflector plate is translatable relative to the at least one wall to vary the spacing between the deflector plate surface and the wall surface.

According to another aspect of the present disclosure, a system is also provided including a vibratory apparatus and a separator attachment that is attachable and detachable from the vibratory apparatus. The vibratory apparatus includes (i) a material-conveying surface with an inlet end and an outlet end, (ii) a plurality of resilient members supporting the material-conveying surface, and (iii) a vibration generator coupled to the material-conveying surface to move material along the material-conveying surface from the inlet end to the outlet end. The separator attachment includes (i) a housing coupled below the material-conveying surface at the outlet end, the housing defining a pressure chamber with an inlet, an outlet and at least one wall with a wall surface having a first end disposed proximate to the outlet of the pressure chamber and a second end, and (ii) a deflector plate with a deflector plate surface having a first end disposed proximate to the outlet of the pressure chamber and a second end, the deflector plate surface facing the wall surface, the deflector plate translatable relative to the at least one wall to vary the spacing between the deflector plate surface and the wall surface.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
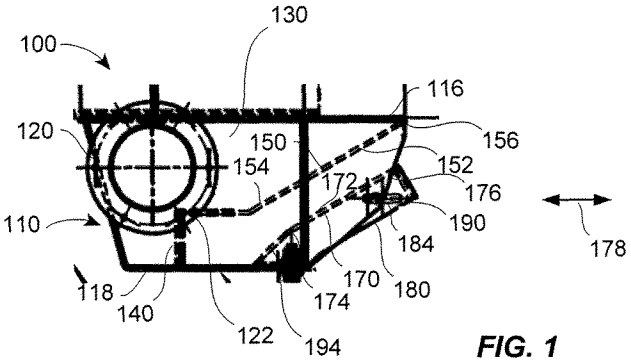
FIG. 1 is a side view of a separator attachment according to the present disclosure.

FIG. 1 illustrates a separator attachment 100 according the present disclosure. The separator attachment 100, as explained in greater detail below with reference to FIGS. 3 and 4, may be mounted at an end of a vibratory apparatus to provide a separation or classification function. That is, the separator attachment 100 provides an adjustable air stream that can be used to separate, for example, materials having different densities into separate piles. However, the separator attachment 100 may be attached to, detached from, and reattached to the apparatus without changing the primary structure and operation of the apparatus. It is also within the scope of the present disclosure to have the attachment 100 integrally formed with the vibratory apparatus, but otherwise positioned as explained below.

Returning to FIG. 1, the separator attachment 100 may include a housing 110. The housing 110 may be mountable to a vibratory apparatus below a material-conveying surface of the vibratory apparatus. For example, the housing 110 may be coupled to the vibratory apparatus using fasteners, such as bolts.

The housing 110 may include plates 112, 114, 116, 118, and 120. These plates may be referred to herein as end plates 112, 114, top plate 116, bottom plate 118 and back plate 120 for ease of discussion, although it will be recognized that use of any particular orientation system is not intended to be limiting on the orientation of the housing 110 when attached to a vibratory apparatus in practice. The housing 110 also may include a plate assembly 122, which may be referred to as the front plate assembly 122. The plates 112, 114, 116, 118, 120 and assembly 122 may enclose a space referred to herein as a pressure chamber 130.

The end plates 112, 114 may each have an opening 132, 134 formed therein, which opening 132, 134 is in communication with the pressure chamber 130. A flanged fitting 136, 138 may be coupled to the end plates 112, 114 at the openings 132, 134 to define a potential inlet for the pressure chamber 130. Further, the front plate assembly 122 may include a perforated plate 140 (see FIG. 2), which plate 140 may define an outlet for the pressure chamber 130.

The front plate assembly 122 also includes a wall 150 that is disposed at an angle to the horizontal. The wall 150 has a wall surface 152 with a first end 154 that is disposed proximate to the outlet of the pressure chamber 130, and a second, spaced end 156. With the separator attachment 100 mounted to a vibratory apparatus, the second end 156 would be proximate to the material-conveying surface of the apparatus.

The separator attachment 100 may also include a deflector plate 170. The deflector plate 170 may have a deflector plate surface 172 with a first end 174 disposed proximate to the outlet of the pressure chamber 130 and a second end 176. With the deflector plate 170 in its operative position, the deflector plate surface 172 faces the wall surface 152.

The deflector plate 170 is translatable relative to the wall 150 to vary the spacing between the deflector plate surface 172 and the wall surface 152. In particular, as illustrated in FIG. 1, the plate 170 may move along a line of motion indicated by the double-headed arrow 178. When the deflector plate 170 translates along the line of motion 178, the spacing between all points on the wall surface 152 and the deflector plate surface 172 increases or decreases by the same amount. The uniform change in spacing between the surfaces 152, 172 is believed to assist in providing predictable changes in the separation of a material stream caused by the air flowing through the space between the surfaces 152, 172.

To guide the movement of the plate 170 along the line of motion 178, the deflector plate 170 has end plates 180 (only one of which may be seen in FIG. 1) each with an elongated slot 184. The slots 184 are disposed parallel to the line of motion 178 of the deflector plate 170. Fasteners 190 are received in the slots 184 in the end plates 180 of the deflector plate 170 to attach the deflector plate 170 to the housing 110. It will be recognized that the cooperation of the fasteners 190 and the slots 184, as well as that of an edge 194 of the plate 170 and the bottom plate 118, should guide the motion of the plate 170 along the line of motion 178.

It will be recognized from FIG. 1 that the wall surface 152 and the deflector plate surface 172 are planar and parallel to each other. However, according to other embodiments of the present disclosure, the surfaces 152, 172 may be curved, may have an irregular surface treatment, or may differ from the planar surfaces illustrated in some other fashion. Also, rather than being parallel, the surfaces 152, 172 may diverge or converge between their first and second ends 154, 174, 156, 176.

It will also be recognized from FIG. 1 that the wall surface 152 and the deflector plate surface 172 are disposed at a particular angle relative to the horizontal as illustrated. As the surfaces 152, 172 guide the air flow through the space between the surfaces 152, 172, their orientation relative to the horizontal is relevant to the direction of the air provided by the separator attachment 100. It will be recognized that the angle of the surfaces 152, 172 relative to the horizontal may change according to the orientation of the separator attachment 100 when it is mounted to the vibratory apparatus, and the orientation of the vibratory apparatus relative to the ground.

Figure 2:
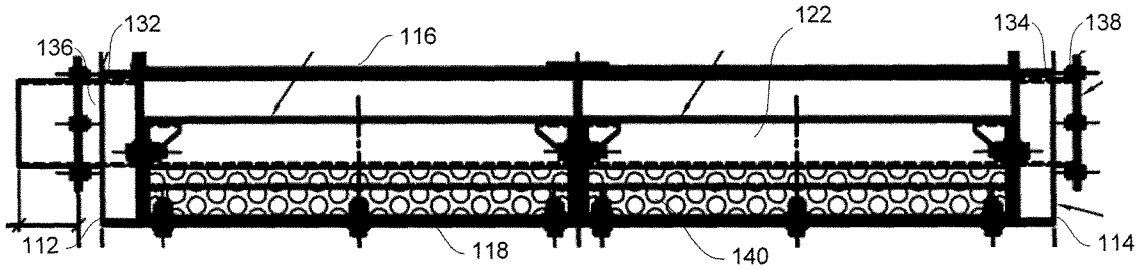
FIG. 2 is a an end view of the separator attachment of FIG. 1 with the adjustable deflector plate removed.
Figure 3:
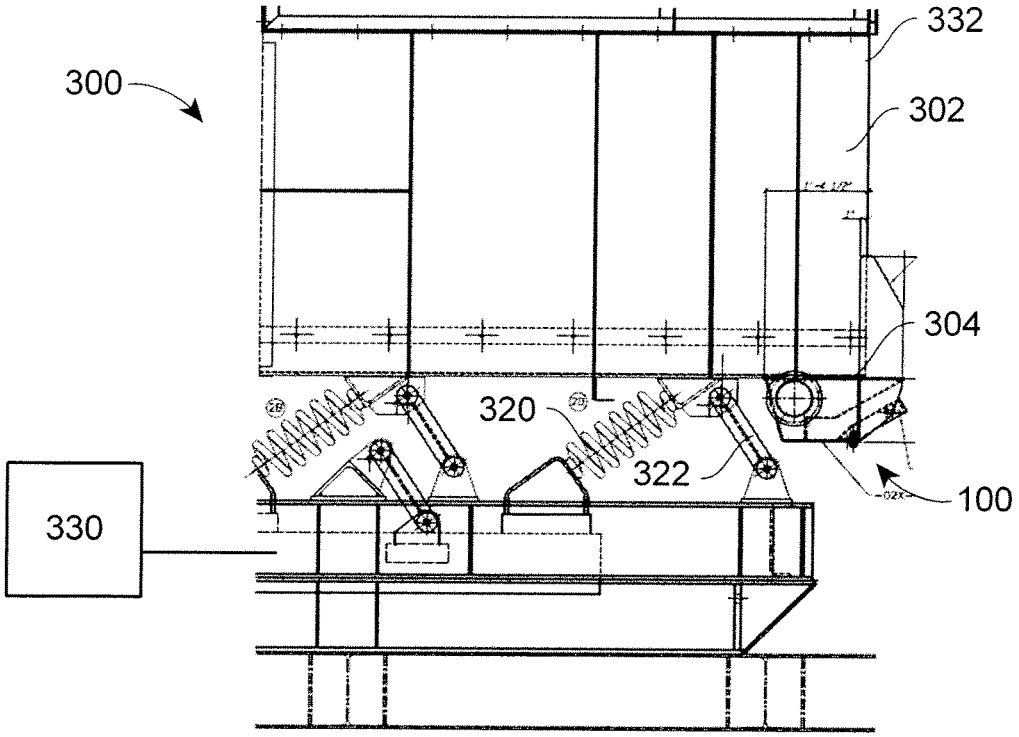
FIG. 3 is a fragmentary side view of a vibratory system including a vibratory apparatus and a separator attachment according an embodiment of the present disclosure.
Figure 4:
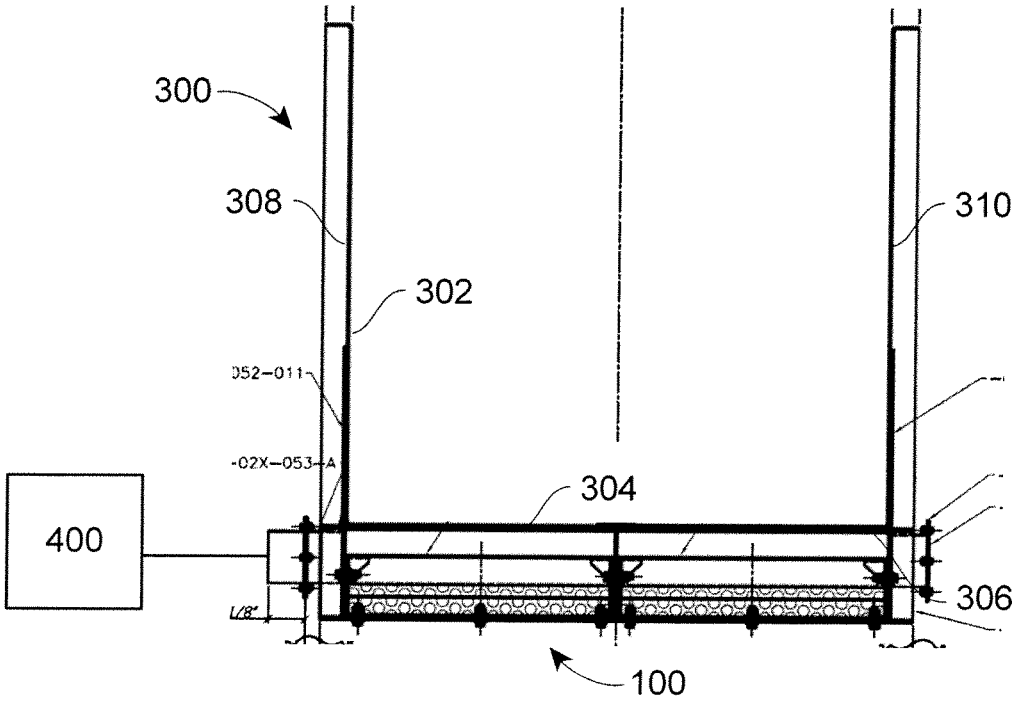
FIG. 4 is an end view of the vibratory apparatus and separator attachment of FIG. 3, with an adjustable deflector plate removed as in FIG. 2.

FIGS. 3 and 4 illustrate the embodiment of the separator attachment 100 illustrated in FIGS. 1 and 2 as it is mounted to a vibratory apparatus 300 to define a system. It will be recognized that the separator attachment 100 is attachable and detachable from the vibratory apparatus 300, such that the vibratory apparatus 300 may be operated with the separator attachment 100 or without it. It will also be recognized that the separator attachment 100 may thus represent a kit or add-on that may be combined with the vibratory apparatus 300 by a user after purchase of the vibratory apparatus 300 from the manufacturer.

The vibratory apparatus 300 may include a trough 302 with a material-conveying surface 304. The material-conveying surface 304 happens to coincide with a bottom 306 of the trough 302 as illustrated, but it will be recognized that the material-conveying surface 304 may be spaced from the bottom of the trough. Stated differently, where the trough 302 has side walls 308, 310, as is illustrated in FIG. 4, the material conveying surface 304 need not be located at any particular height along the side walls 308, 310. Of course, it will also be recognized that the material-conveying surface 304 need not be defined by a surface of a trough with opposed side walls 308, 310 as illustrated; a deck with lower or no side walls may also define the material-conveying surface 304.

As illustrated in FIGS. 3 and 4, the separator attachment 100 may be mounted under the material-conveying surface 304, extending from one side wall 308 to the other side wall 310. Additionally, the separator attachment 100 appears to depend past the material-conveying surface 304. However, the attachment 100 need not depend past the material-conveying surface 304 according to all embodiments, and the attachment 100 need not extend from one side wall 308 to the other side wall 310 according to all embodiments. For example, the attachment 100 may be mounted so that the housing 110 is entirely below the material-conveying surface 304. Also, the attachment 100 may only depend over a portion of the distance between the side walls 308, 310, so as to direct an air flow against only material exiting the apparatus 300 over this distance.

The vibratory apparatus 300 may also include one or more resilient members 320, which resilient members 320 may be coil springs as illustrated. According to the illustrated embodiment, the resilient members 320 may be paired with linkages 322, although that need not be case according to every embodiment of vibratory apparatus 300 to which the separator attachment 100 may be coupled.

The vibratory apparatus 300 may further include a vibration generator 330, which generator is coupled to the apparatus 300 to move material along the material-conveying surface 304 from an inlet end to an outlet end 332. The vibration generator 330 may take a variety of forms. The vibration generator 330 may be coupled to the trough 300 directly, or through a resilient member, or via a counterbalance that is coupled to the trough 300. The vibration generator 330 may include a motor coupled to one or more eccentric weights, or the generator 330 may include an pneumatic or hydraulic actuator. It will be recognized that the present disclosure is not limited in this regard.

For that matter, the vibratory apparatus 300 is not limited to only those apparatuses 300 that simply convey material from an inlet to an outlet. While the apparatus 300 may be a vibratory conveyor or feeder, the apparatus 300 may also be a vibratory separator or classifier. In the latter instance, the apparatus 300 may make one or more separations of the material passing through the vibratory apparatus 300 prior to the material being separated further by the separator attachment 100 disposed at the outlet end 332.

The separator attachment 100 may be combined with a source of pressurized air 400, such as is illustrated in FIG. 4. The source of pressurized air 400 may be in the form of one or more blowers, and may be disposed at a distance from the apparatus 300. Where the source 400 is not mounted to the apparatus, the source 400 may be connected to the attachment 100 via one or more conduits, at least a portion of which may be flexible to accommodate the motion of the apparatus 300 to which the attachment 100 is mounted. In an embodiment wherein the apparatus 300 is a classifier, a source of pressurized air may already be associated with the apparatus 300, in which case air may be diverted to operate the attachment 100.

It is believed that the present disclosure may have several benefits, one or more of which may be present in a particular embodiment according to the present disclosure. For example, the attachment 100 permits any apparatus to have a separation feature or function without otherwise affecting the primary structure or operation of the apparatus. Therefore, the attachment may be used provide a separation feature for a conveyor, or an additional separation feature to a classifier. Moreover, the decision to provide the separation feature or additional separation feature need not be made at the time of the manufacture or purchase of the apparatus, nor must that decision be a permanent one for the apparatus. Thus, the attachment 100 may provide increased flexibility in operating vibratory apparatuses, which flexibility may be enhanced through the inclusion of an adjustable deflector plate in the attachment 100.

What is claimed is:

1. A separator attachment for use with a vibratory apparatus, the attachment comprising:

a housing adapted to be attached to and detached from a vibratory apparatus below a material-conveying surface of the vibratory apparatus, the housing defining a pressure chamber with an inlet and an outlet, the housing having at least one wall with a wall surface having a first end disposed proximate to the outlet of the pressure chamber and a second end; and a deflector plate with a deflector plate surface having a first end disposed proximate to the outlet of the pressure chamber and a second end, the deflector plate surface facing the wall surface and spaced from the wall surface to define an air passage therebetween, the deflector plate translatable relative to the at least one wall between a first position, wherein the deflector plate is translated nearer to the at least one wall so that the first ends and second ends of the deflector plate surface and the wall surface to define a first width for the air passage therebetween, and a second position, wherein the deflector plate is translated farther away from the at least one wall so that the first ends and second ends of the deflector plate surface and the wall surface to define a second width for the air passage therebetween, the second width being different than the first width.

2. The separator attachment of claim 1, wherein the wall surface and the deflector plate surface are planar and parallel to each other.

3. The separator attachment of claim 2, wherein the wall surface and the deflector plate surface are disposed at an angle relative to the horizontal.

4. The separator attachment of claim 1, the deflector plate being translatable relative to the at least one wall along a line of motion, the deflector plate having end plates each with an elongated slot, the slots being parallel to the line of motion of the deflector plate.

5. The separator attachment of claim 4, comprising fasteners received in the slots in the end plates of the deflector plate to attach the deflector plate to the housing.

6. The separator attachment of claim 1, comprising a perforated plate disposed at the outlet of the pressure chamber.

7. A system comprising:

a vibratory apparatus including (i) a material-conveying surface with an inlet end and an outlet end, (ii) a plurality of resilient members supporting the material-conveying surface, and (iii) a vibration generator coupled to the material-conveying surface to move material along the material-conveying surface from the inlet end to the outlet end; and a separator attachment adapted to be attached to and detached from the vibratory apparatus, the separator attachment comprising (i) a housing detachably coupled below the material-conveying surface at the outlet end, the housing defining a pressure chamber with an inlet, an outlet and at least one wall with a wall surface having a first end disposed proximate to the outlet of the pressure chamber and a second end, and (ii) a deflector plate with a deflector plate surface having a first end disposed proximate to the outlet of the pressure chamber and a second end, the deflector plate surface facing the wall surface and spaced from the wall surface to define an air passage therebetween, the deflector plate translatable relative to the at least one wall between a first position, wherein the deflector plate is translated nearer to the at least one wall so that the first ends and second ends of the deflector plate surface and the wall surface to define a first width for the air passage therebetween, and a second position, wherein the deflector plate is translated farther away from the at least one wall so that the first ends and second ends of the deflector plate surface and the wall surface to define a second width for the air passage therebetween, the second width being different than the first width.

8. The system of claim 7, wherein the wall surface and the deflector plate surface are planar and parallel to each other.

9. The system of claim 8, wherein the wall surface and the deflector plate surface are disposed at an angle relative to the horizontal.

10. The system of claim 7, the deflector plate being translatable relative to the at least one wall along a line of motion, the deflector plate having end plates each with an elongated slot, the slots being parallel to the line of motion of the deflector plate.

11. The system of claim 10, comprising fasteners received in the slots in the end plates of the deflector plate to attach the deflector plate to the housing.

12. The system of claim 7, wherein the at least one wall defines in part the pressure chamber.

13. The system of claim 7, comprising a perforated plate disposed at the outlet of the pressure chamber.

14. The system of claim 7, wherein the vibratory apparatus is a vibratory conveyor.

15. The system of claim 7, wherein the vibratory apparatus is a vibratory classifier.

16. The separator attachment of claim 1, wherein the at least one wall defines in part the pressure chamber.

* * * * *